US005746322A

United States Patent [19]

LaVeine et al.

[11] Patent Number: 5,746,322

[45] Date of Patent: May 5, 1998

[54] VIBRATORY FINGER SCREEN WITH LATERAL WEDGE MEMBERS

[75] Inventors: Andrew T. LaVeine, Newberg; Stanley L. Humiston, Beaverton, both of Oreg.

[73] Assignee: Action Equipment Co., Inc., Newberg, Oreg.

[21] Appl. No.: 674,398

[22] Filed: Jul. 2, 1996

[51] Int. Cl.[6] ..... B07B 1/49

[52] U.S. Cl. ..... 209/393; 209/674

[58] Field of Search ..... 209/233, 311, 209/314, 393, 395, 659, 660, 674

[56] References Cited

U.S. PATENT DOCUMENTS 5,108,589 4/1992 Sherman ..... 209/674 X
5,150,798 9/1992 Mills, Jr. ..... 209/660
5,462,174 10/1995 Truckenbrod et al. ..... 209/674 X

FOREIGN PATENT DOCUMENTS 1009462 5/1957 Germany ..... 209/674

*Primary Examiner*—William E. Terrell
*Assistant Examiner*—Tuan Nguyen
*Attorney, Agent, or Firm*—Chernoff, Vilhauer, McClung & Stenzel

[57] ABSTRACT

A vibratory screening machine for separating materials according to particle size includes a vibratory frame and a sizing screen supported by the frame having a plurality of finger plates. Each of the finger plates includes a plurality of fingers separated by lateral gaps therebetween and each of the fingers includes a side deflector wedge extending substantially vertically downwardly from the fingers thereby providing a chute for a properly sized product to fall through.

14 Claims, 3 Drawing Sheets

VIBRATORY FINGER SCREEN WITH LATERAL WEDGE MEMBERS

The following invention relates to a vibratory screening conveyor and in particular to such a conveyor employing a finger screen for separating materials according to size.

Vibratory screen conveyors that classify material according to size are well known in the art. For example, a vibratory finger screen conveyor of this general type is shown in U.S. Pat. No. 5,108,589 entitled MATERIAL SEPARATING APPARATUS. Vibratory screens of this type have sizing screens comprising fingers extending from crosspieces or plates which are arranged adjacent to one another to form a sizing screen. There are diverging gaps between the fingers to allow sized material to drop through the screen. Generally, the fingers of one finger plate are oriented so that they point toward the gaps of the next adjacent finger plate thus presenting a staggered pattern. The finger plates are attached to side plates mounted within a vibrating frame having sides that form a pan or trough. The trough is usually supported by heavy springs on a base frame, and a motor is attached to the spring loaded frame to make the frame vibrate. Under the effect of the vibration, material deposited at an input end flows across the finger screen to an output end. Because the trough vibrates, undersized particles of materials or product fall through the gaps between the adjacent fingers into collection areas below the screens. Larger material is carried to the output end.

A frequent use of such conveyor screens is in connection with material which must be reduced in size to a required particle size. Material is deposited from a size reduction machine into the input end of the conveyor. As the material passes across the finger screen, undersized material drops through the gaps into collection areas below while oversized material may be recycled through the size reduction machine. An example of such material is tires. Old tires are recycled, but recycling operations require that the tires be shredded to a predetermined particle size. Many such tires are passenger car or truck tires and have embedded steel or bead wire. These wires may become exposed as the tires are sent through the shredder.

Prior art conveyor screens such as that shown in the Sherman '589 patent cited above, have difficulty sorting such material. The fingers of each finger screen are thin in the vertical dimension, and have a vertical spacing above the next adjacent finger plate. Material can therefore lodge in the space under the fingers. Shreds of tires partially enter gaps between fingers but then move laterally while conveying in a forward direction. This material becomes stuck between the underside of a finger and the next forward finger plate. A number of such pieces of material hanging up on the finger screen can block other pieces from falling through the screen. This phenomenon in turn creates a bed of plugged and non-moving material along the surface of the finger screen that causes other smaller material to "surf" along the top of the finger screen and fail to fall through the openings to the collection areas below. Screen efficiency is thus decreased because openings are plugged. In addition, lateral movement of oversized pieces can result in misclassification because such pieces may first become lodged under the fingers, but then fall into collection areas below.

Some finger screens have in the past employed gussets beneath the fingers to provide structural strength. Gussets have been used primarily on screens for heavy materials having large openings, typically in the ranges of 3" or more. Gussets are merely centered support ribs, however, and are ineffective in preventing lateral movement of material underneath the fingers.

A desirable object of any vibratory finger screen conveyor would be to prevent pieces or particles of material from getting caught on the surface of the finger screen or under the finger tips and blocking openings through which properly sized material should fall.

SUMMARY OF THE INVENTION

According to the invention a vibratory screen machine for separating materials according to particle size includes a vibratory frame and a sizing screen supported by the vibratory frame wherein the sizing screen comprises a plurality of finger plates, each finger plate having a plurality of fingers separated by lateral gaps therebetween and oriented substantially horizontally pointing in a direction of flow. Each of the plurality of fingers has at least one lateral deflecting wedge extending substantially vertically downwardly from the fingers to block lateral movement of material under the fingers and thus prevent it from plugging the conveyor screen. The wedges also prevent oversized pieces from moving sideways under the fingers and eventually dropping into collection areas below.

These lateral deflector wedges thus form divergent chutes between fingers through which properly sized product falls into collector areas below. Preferably lateral deflector wedges are attached to the fingers to provide a pair of lateral surfaces, each lateral deflector wedge surface pair being attached flush with the outside edge of each finger so as to eliminate any irregular surface upon which material could snag. The deflector wedge surfaces may be angled toward each other in a lateral direction beneath each finger such that the gap between adjacent fingers becomes larger in a vertically downwardly direction. This ensures that particles or pieces of material that enter the chutes are allowed to fall completely through and not move laterally and become hung up underneath the fingers.

The lateral deflector wedges may be triangularly shaped and have lower tip portions which are joined at the lower tip. The lateral wedges thus formed have an inclined edge which is oriented parallel to and substantially flush with the next forwardly adjacent finger plate. This latter feature is due to the fact that the finger plates include a rear depending backplate which is joined to the backbone of the finger plates at an obtuse angle. Since the deflector wedges have a forward angle that is substantially flush with and closely spaced to the rear depending backplate of the next adjacent forward finger plate, there is little opportunity for pieces of material to become wedged between the fingers of one finger plate and the rear depending backplate of the next adjacent forward finger plate. This allows the vertical clearance of the fingers to be adjusted without the problem of material becoming wedged under the fingers.

The lateral deflector wedges thus formed may be attached to the fingers in any conventional manner such as by welding. However, there could also be clips or other devices which may be retrofitted to existing finger screen conveyors. Furthermore, if desired, the lateral deflector wedges may consist of a unitary piece shaped somewhat like a narrow irregular pyramid (or truncated pyramid if the surfaces are not joined at the bottom).

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
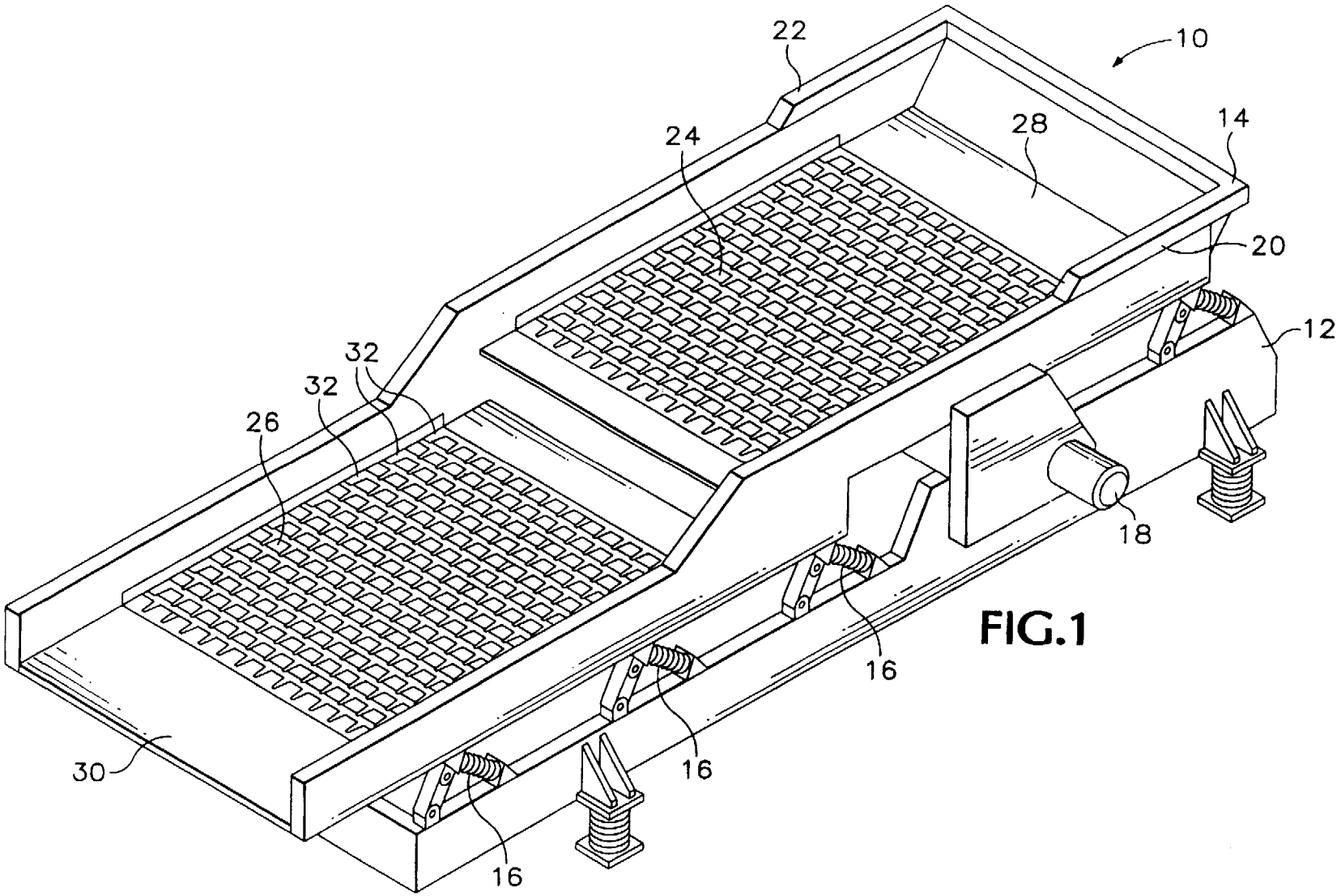
FIG. 1 is a perspective view of a vibratory finger screen conveyor of the type employing the present invention.

A vibratory finger screen conveyor 10 includes a frame 12 which supports a vibratory frame 14 on springs 16. A motor 18 is attached to the frame 14 which when active, causes the frame 14 to vibrate. The frame 14 includes sides 20 and 22 which form a trough with respect to a finger screen conveyor bed 24. In FIG. 1 there are two such finger screen conveyor beds and a second finger screen bed 26 may be used to provide openings of a different size so that two sizes of material pieces may be sorted at once. The conveyor 10 has an input end 28 and an output end 30. Located beneath the finger screen beds 24 and 26 are receptacles or subpans (not shown) which collect pieces which fall through as material is conveyed from the input end 28 to the output end 30.

Figure 2:
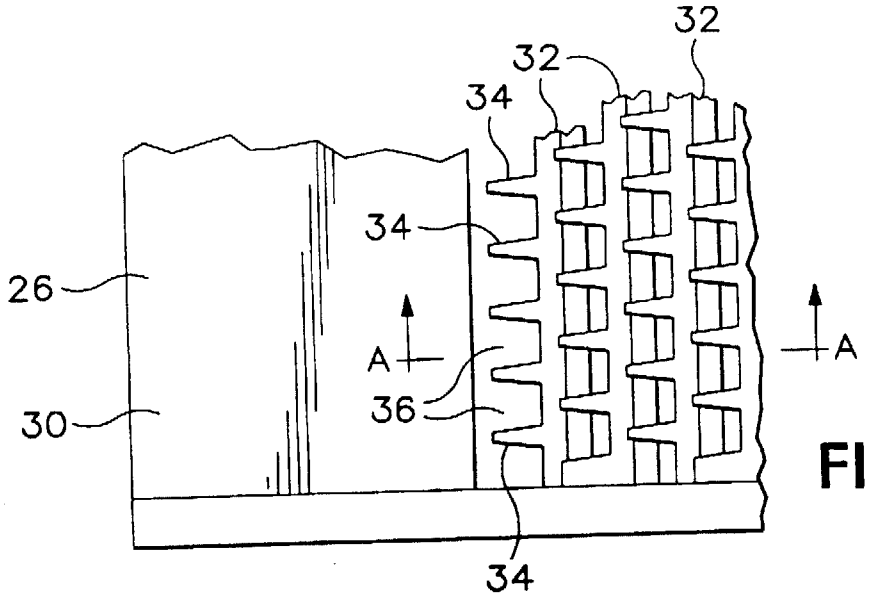
FIG. 2 is a partial top view of the vibratory finger screen conveyor of FIG. 1.

Referring to FIG. 2, the finger screen 26 comprises a plurality of finger plates 32, wherein each finger plate 32 comprises a transverse piece of metal that extends substantially between the sides 20 and 22 of the vibratory conveyor 10. Each finger plate 32 includes a plurality of tapered fingers 34 separated by divergent gaps 36. Each finger plate 32 is arranged so that its fingers 34 are staggered with respect to the gaps 36 of the next forwardly adjacent finger plate.

Figure 3:
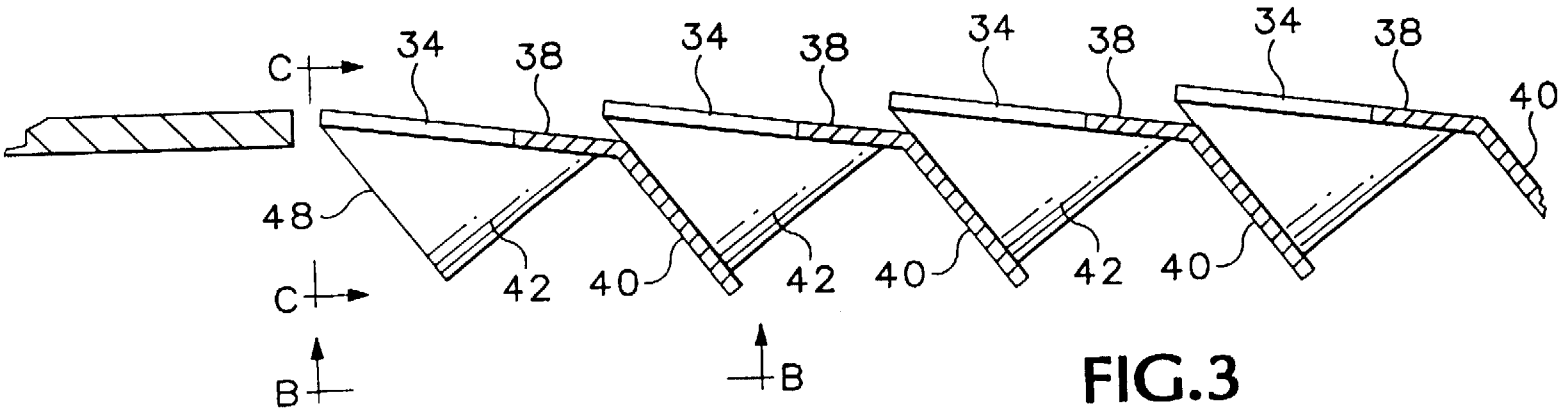
FIG. 3 is a side cutaway view taken along A—A of FIG. 2.
Figure 4:
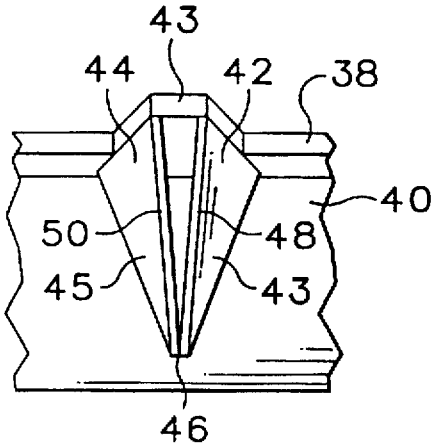
FIG. 4 is a front view taken along line C—C of FIG. 3.
Figure 5:
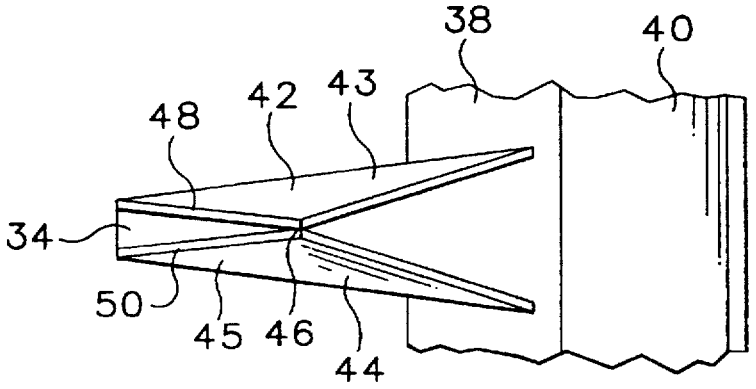
FIG. 5 is a bottom view taken along line B—B of FIG. 3.

Referring to FIG. 3, each finger plate 32 includes a backbone 38 and a rear depending backplate 40 that is joined at an obtuse angle to the backbone 38. As shown best in FIG. 4, each finger 34 has attached to it a pair of lateral deflector wedges 42 and 44. These wedges are generally triangular and are joined at a tip 46. The wedges 42 and 44 may be attached to each finger 34 to be flush with its side edge so as to present a smooth surface in the gap area immediately underneath each of the fingers 34. Furthermore, the wedges 44 and 42 are inclined laterally inwardly toward each other, having tilted lateral surfaces 43 and 45 so as to present a gradually widening chute between each of the fingers 34 for properly sized product to fall through. Each of the side deflector wedges 42, 44 has a forward edge 48, 50 respectively, which is parallel to the planar backplate surface of the next adjacent rear depending backplate 40. There is very close spacing between the forward edges 48 and 50 and the backplates 40 so that they are almost flush. This helps to prevent material from lodging underneath the fingers of one finger plate and the backbone or rear depending backplate of the next adjacent finger plate.

Figure 6:
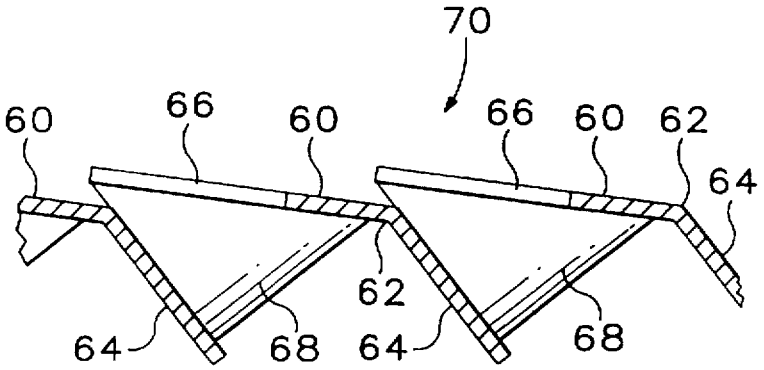
FIG. 6 is a partial side view of an alternative embodiment of a vibratory finger screen used with the invention.

An alternative embodiment of the invention is shown in FIG. 6. Each finger plate 60 includes a backbone 62 and a backplate 64, as well as a plurality of fingers 66. In this respect the finger plates are identical to those shown in FIG. 3. The lateral wedges 68 are, however, welded or otherwise affixed to the backplates 64 as well as to the fingers 66. This makes the finger screen 70 a unitary structure instead of a plurality of independent finger plates. In another variation, wedges could be welded to the backplates of the finger plates, but not to the adjacent fingers, thus allowing for narrow clearance between each wedge and a nearest adjacent upstream finger.

The lateral deflector wedges 42 and 44 may be made as a unitary piece if desired. In such a case the piece thus formed would resemble a narrow irregular pyramid. A unitary piece would have laterally inwardly tilted side surfaces so as to present a gradually opening chute between each of the fingers 34 for material to fall through. The best design of such a piece would encase each finger on all sides so that there would be no exposed narrow surfaces for material to hook around and/or become lodged in an opening of the screen.

The lateral deflector wedges 42 and 44 have been shown as having a triangular shape when viewed from the side. However, it will be appreciated that such wedges may have any shape that conveniently prevents lateral movement underneath the finger screen. In the case illustrated in FIG. 3, it will be apparent that wedges 42 and 44 could be shaped like parallelograms so that their lower edges extended to the backplate instead of to a point near the backbone. In addition, it will be apparent that the shape of the side deflector wedges depends upon the design of the finger plates themselves. If a finger plate does not have a rear depending backplate formed at an obtuse angle to a backbone, the wedges may require a different shape. For example, if the backplate is angled to point vertically downwardly, the wedges should be rectangular. Thus, the particular shape of the lateral deflector wedges will be determined in part by the geometry of the finger plates. In addition, although the wedges have been shown as being joined at the tip, it is not necessary that they be constructed in this way in all cases. Particularly, with large screens having wide gap openings, the wedges need not be joined and may even be truncated at the bottom.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A vibratory screening machine for separating materials according to particle size comprising:

(a) a vibratory frame;

(b) a sizing screen supported by the frame, the sizing screen comprising a plurality of finger plates, each finger plate having a plurality of fingers, the fingers in said plurality comprising a tip portion and a pair of tapered sides, and separated by lateral gaps therebetween, said plurality of fingers having at least one lateral wedge member extending substantially vertically downwardly from said fingers, said at least one lateral wedge member including a pair of lateral wedge surfaces, each one of said lateral wedge surfaces depending from each tapered side of said fingers, respectively.

2. The vibratory screening machine of claim 1 wherein said pair of lateral wedge surfaces are angled toward each other in a lateral direction beneath said fingers such that said gaps between adjacent fingers become larger in a vertically downwardly direction.

3. The vibratory screening machine of claim 2 wherein said lateral wedge members are triangularly shaped, having a lower tip portion, and each pair of said lateral wedge members are joined at said lower tip portions.

4. The vibratory screening machine of claim 1 wherein said lateral wedge members have inclined edges aligned substantially flush against a forwardly adjacent finger plate.

5. The vibratory screening machine of claim 1 wherein said finger plates comprise a backbone and a backplate depending from said backbone at an obtuse angle, said lateral wedge members having forward edges substantially parallel to a backplate of a next forwardly adjacent finger plate and spaced closely thereto.

6. The vibratory screening machine of claim 5 wherein a pair of said lateral wedge surfaces depend from each one of said plurality of fingers.

7. The vibratory screening machine of claim 1 wherein said lateral wedge surfaces are tilted toward each other to provide a gradually widening chute region beneath each of said finger plates.

8. The vibratory screening machine of claim 7 wherein said lateral wedge members are triangularly shaped and said surfaces are joined at a tip thereof.

9. A vibratory screening machine for separating material according to particle size comprising:

(a) a vibratory frame;

(b) a sizing screen comprising a plurality of finger plates extending substantially across said frame, each of said finger plates having a plurality of tapered fingers separated by gaps, a backbone supporting said fingers, and a rear depending backplate oriented at an angle to said backbone; and (c) a plurality of lateral wedge members depending from said fingers, said lateral wedge members having forward edges adjacent to and substantially flush with a backplate of a next adjacent finger plate.

10. The vibratory screening machine of claim 9 wherein said lateral wedge members have lateral surfaces inclined laterally inwardly of said gaps between said fingers to create gradually widening chutes beneath said fingers.

11. The vibratory screening machine of claim 10 wherein there is a pair of said lateral wedge members for each one of said plurality of tapered fingers.

12. The vibratory screening machine of claim 10 wherein said lateral surfaces are triangularly shaped.

13. The vibratory screening machine of claim 12 wherein said lateral surfaces join together at a triangular tip.

14. The vibratory screening machine of claim 9 wherein said forward edges of said lateral wedge members are attached to said backplate of a next adjacent finger plate.

* * * * *